US010844647B2

(12) United States Patent
Bars

(10) Patent No.: US 10,844,647 B2
(45) Date of Patent: Nov. 24, 2020

(54) METHOD FOR OPERATING A DOOR MODULE OF A MOTOR VEHICLE

(71) Applicant: Brose Fahrzeugteile GmbH & Co. Kommanditgesellschaft, Bamberg, Bamberg (DE)

(72) Inventor: Sebastian Bars, Bamberg (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 176 days.

(21) Appl. No.: 16/120,796

(22) Filed: Sep. 4, 2018

(65) Prior Publication Data

US 2019/0071914 A1 Mar. 7, 2019

(30) Foreign Application Priority Data

Sep. 1, 2017 (DE) ..... 10 2017 215 383

(51) Int. Cl.
*E05F 15/611* (2015.01)
*E05F 15/40* (2015.01)
*E05F 15/689* (2015.01)
*E05F 15/695* (2015.01)

(52) U.S. Cl.
CPC ..... *E05F 15/611* (2015.01); *E05F 15/40* (2015.01); *E05F 15/689* (2015.01); *E05F 15/695* (2015.01); *E05Y 2400/42* (2013.01); *E05Y 2900/531* (2013.01); *E05Y 2900/55* (2013.01)

(58) Field of Classification Search
None
See application file for complete search history.

(56) References Cited

U.S. PATENT DOCUMENTS 6,477,806 B1 * 11/2002 Asada ..... E05D 15/101 296/146.2
6,794,837 B1 * 9/2004 Whinnery ..... H02H 7/0851 318/266
2004/0194385 A1 * 10/2004 Ichinose ..... E05F 15/43 49/26
2007/0107313 A1 * 5/2007 Suzuki ..... E05F 15/41 49/360

(Continued)

FOREIGN PATENT DOCUMENTS

CN 105229250 A 1/2016
DE 102011113174 A1 11/2012

OTHER PUBLICATIONS

Chinese Office Action dated Jan. 15, 2020 in corresponding application CN201810993133.1.

*Primary Examiner* — Marcus Menezes
(74) *Attorney, Agent, or Firm* — Muncy, Geissler, Olds & Lowe, P.C.

(57) ABSTRACT

A method for operating a door module of a motor vehicle, having a door which is driven by means of a motorized door adjuster, and having a windowpane which is driven by means of a motorized window lift. A first request for adjusting the windowpane is detected, and the window pane is adjusted depending on the first request. A second request for adjusting the door is detected, and the door is adjusted depending on the second request. The adjustment of the windowpane is ended at least temporarily while the door is adjusted. A door module of a motor vehicle is also provided.

11 Claims, 2 Drawing Sheets

(56) References Cited

U.S. PATENT DOCUMENTS

| | | | | |
|---|---|---|---|---|
| 2007/0138832 | A1* | 6/2007 | Kraus | B60J 5/06 296/155 |
| 2010/0156440 | A1* | 6/2010 | Weingartner | E05F 15/46 324/658 |
| 2012/0234621 | A1* | 9/2012 | Syvret | E05F 15/70 180/281 |
| 2013/0276748 | A1* | 10/2013 | Kromer | H02H 7/0851 123/319 |
| 2015/0354260 | A1* | 12/2015 | Pruessel | E05F 15/695 49/31 |
| 2016/0215553 | A1* | 7/2016 | Shibata | E05F 15/73 |
| 2017/0174054 | A1* | 6/2017 | Okuma | E05D 15/1047 |
| 2019/0063137 | A1* | 2/2019 | Suzuki | E05F 15/689 |

* cited by examiner

METHOD FOR OPERATING A DOOR MODULE OF A MOTOR VEHICLE

This nonprovisional application claims priority under 35 U.S.C. § 119(a) to German Patent Application No. DE 10 2017 215 383.0, which was filed in Germany on Sep. 1, 2017, and which is herein incorporated by reference.

BACKGROUND OF THE INVENTION

Field of the Invention

The present invention relates to a method for operating a door module of a motor vehicle, having a door which is driven by means of a motorized door adjuster, and having a windowpane which is driven by means of a motorized window lift. The invention further relates to a door module of a motor vehicle.

Description of the Background Art

To increase comfort, motor vehicles have motorized door adjusters. In this case, when activated, a door, such as a tailgate or a side door, is swung by means of an electric motor. The electric motor is operatively connected to the door by means of a worm gear or the like, so that the door is either opened or closed depending on the rotary motion of the electric motor. The electric motor of the motorized door adjuster is usually activated by means of a switch which is located on the door, for example, within a door handle. Typically, the energization of the electric motor essentially takes place immediately after the respective motorized door adjuster is activated, so that it is readily apparent to the user that the command for activating the electric motor was correctly detected. The electric motor itself is usually designed brushless and is regulated by means of a regulator to a certain speed, so that the door is moved at a predetermined speed. In this case, for example, a substantially constant speed is predetermined.

Likewise to increase comfort, motor vehicles in addition have windowpanes, which are driven by means of a motorized window lift. In this case, the windowpane is opened or closed by means of an electric motor of the motorized window lift. The windowpane and the motorized window lift are connected, for example, to the door. Usually, a door module, which has, for example, a carrier, which is injection-molded in particular from a plastic, is used for simplified assembly. Both the motorized door adjuster and the motorized window lift are connected to the carrier. In addition, the door is connected to the carrier and thus positioned in a defined position both with respect to the motorized window lift and the motorized door adjuster. Furthermore, the carrier usually has a guide for the windowpane.

SUMMARY OF THE INVENTION

It is therefore an object of the present invention to provide a method for operating a door module of a motor vehicle and a particularly suitable door module of a motor vehicle, wherein advantageously manufacturing costs and/or complexity are reduced.

The method can be used to operate a door module of a motor vehicle, which is, for example, a passenger car. The door module has a door which is driven by means of a motorized door adjuster of the door module. The door is, for example, a driver's door, a passenger door, or a rear door.

Preferably, the door is made of a metal, in particular sheet metal, and/or the door forms part of a body of the motor vehicle. An electric motor of the motorized door adjuster is operatively connected to the door. In particular, a gear, such as a worm gear, is driven by the electric motor, which is operatively connected to the door by means of further components of the motorized door adjuster, for example, by means of a spindle or by means of a cable pull. The door itself preferably has a receiving point for a fitting or the fitting itself, by means of which the door is hinged to another component of the motor vehicle's body, such as a door frame. For example, the fitting is a hinge, so that the door is pivoted with respect to the further part of the body. The door is in particular a side door. Alternatively, the fitting is a running bar, so that the first door is designed similar to a sliding door. The moving path of the first door is therefore either substantially rectilinear or curved.

Depending on the direction of electric motor rotation of the motorized door adjuster, the door is moved in one of two adjustment directions, so that the door is taken from an at least partially closed position to an at least partially open position and thus an opening movement is performed. In the other direction of electric motor rotation, the door is moved from the at least partially open position to an at least partially closed position and thus a closing movement is performed. The electric motor is made, for example, brushless and/or electrically contacted by means of an inverter with a motor vehicle electrical system. The inverter is preferably a component of a control device, by means of which the rotational speed and/or direction of the electric motor rotation are set.

The motorized door adjuster can comprise a closing mechanism, by means of which the door is brought into a locked or at least latched state. In particular, an additional force is applied to the door by selection of a further gear stage or by means of a further electric motor, so that a counterforce applied by a possible seal is overcome.

The door module further has an electric window lift by means of which a windowpane is driven. The motorized window lift has an electric motor by means of which expediently a gear, such as a worm gear, is driven. The worm gear is operatively connected to the windowpane, for example, via a cable pull. In particular, a carriage or the like, which is fastened to the windowpane, is moved by means of the gear. The electric motor is suitably made brushless and is preferably a brushless DC motor (BLDC). Suitably, the electric motor is electrically connected to an inverter, by means of which the electric motor is energized. Depending on the direction of electric motor rotation, the windowpane is hereby opened or closed.

The door module can have a guide for the windowpane. The door module expediently comprises a carrier to which both the motorized door adjuster and the motorized window lift are connected. For example, the carrier is made of a plastic, for example, in a plastic injection molding process. The carrier itself preferably comprises the guide for the windowpane. In particular, the door is connected to the carrier, and the carrier in the assembled state is positioned, for example, between the door and an interior panel and is expediently attached thereto.

For example, the door module has a frame. In particular, the frame is at least partially part of the door. In this case, the windowpane is moved within the frame upon actuation of the motorized window lift, so that the windowpane is stabilized by means of the frame and protected from any damage. Particularly preferably, however, the door module is designed frameless. Thus, in particular, the windowpane is not surrounded by a frame, and, for example, three of the edges of the windowpane, if they are not in the completely open position, are spaced apart from further components of the door module, in particular further components of the motor vehicle. In the closed position, these edges bear against in particular further components of the motor vehicle, which are preferably not part of the door module. For example, these edges bear against a seal of the motor vehicle, which is not moved together with a movement of the windowpane, and which is expediently connected stationarily to a roof or a spar of the motor vehicle.

The method provides that in a first step, a first request for adjusting the windowpane is detected. The first request is transmitted, for example, by means of a bus system of the motor vehicle, in particular a CAN or LIN bus system. The window is adjusted depending on the first request. For this purpose, the motorized window lift is expediently suitably energized and thus the windowpane is adjusted, in particular moved. The adjustment is made such that the first request is fulfilled. Suitably, the windowpane is adjusted by an amount and/or in the direction predetermined by the first request. At least, however, the adjustment is started such that fulfillment of the first request is possible, therefore, that the windowpane is adjusted in the direction corresponding to the first request and/or with the speed corresponding to the first request. In summary, the adjustment movement is started.

In a further step, a second request for adjusting the door is detected. The second request is only detected after the first request, for example, after the beginning of the windowpane adjustment. The second request is received in particular by the bus system, if it is available. Further, the door is adjusted depending on the second request. For this purpose, the motorized door adjuster is suitably driven; in particular its electric motor is suitably energized.

The adjustment of the windowpane is ended at least temporarily while the door is adjusted. In other words, the windowpane is at least temporarily not adjusted, provided the windowpane is not yet in the position specified by the first request. Consequently, the motorized window lift is stopped during a period of time during which the door is adjusted. As a result, only the adjustment of the door occurs for the given period of time, whereas the adjustment of the windowpane does not occur.

Thus, a power consumption of the door module is reduced, which is why electrical lines with a lower current carrying capacity and/or a reduced cross section can be used. Therefore, manufacturing costs and/or weight of the door module are reduced. It is also possible to simplify an interconnection and/or to simplify monitoring for an overcurrent and pinching, which reduces complexity.

For example, the first request corresponds to an adjustment of the windowpane by a certain amount or along the complete adjustment path, for example, from a completely open position to a completely closed position or from a completely closed position to a completely open position. For example, the first request is transmitted only once. Alternatively, the first request corresponds to a continuous signal, so that an adjustment of the windowpane takes place as long as the first request is present/available, for example. The second request corresponds, for example, to an adjustment of the door by a certain amount or along the complete adjustment path, in particular from a completely open position to a completely closed position or from a completely closed position to a completely open position. For example, the second request is transmitted only once or the door is adjusted as long as the second request is present; therefore in particular a specific signal is applied to the motorized door adjuster.

The adjustment of the windowpane can be ended as long as the door is adjusted. In other words, as soon as the door is adjusted, the windowpane is no longer adjusted, regardless of whether it is already in the position specified by the first request. Suitably, as soon as the second request is detected, the adjustment of the windowpane is ended, and the adjustment of the door is only started subsequently. Alternatively, the adjustment of the door takes place substantially simultaneously with the termination of the windowpane adjustment. Thus, a maximum power consumption of the door module is limited, because only either the motorized window lift or the motorized door adjuster must be energized. Thus, comparatively inexpensive lines can be used, which further reduces manufacturing costs.

Alternatively, the adjustment of the windowpane can be ended only when the door is moved against an end stop. The end stop designates in particular the end of the (regular) door adjustment path, wherein the adjustment of the door is limited by the end stop. In an adjustment of the door against the end stop, there is an increase in the force exerted on the door by the motorized door adjuster, so that an electric current acting upon the motorized door adjuster increases. By ending the adjustment of the windowpane, the electrical current, by which the complete door module is energized, decreases or at least remains constant, which is why relatively inexpensive electrical lines can be used. In addition, a relatively rapid adjustment of the windowpane is realized, because this is otherwise adjusted, namely when the door is not moved against the end stop. In particular, just before the end stop is reached, for example, 2 cm, 1 cm, 0.5 cm, or 0.4 cm before the end stop is reached or 5 degrees, 4 degrees, 3 degrees, 2 degrees before the end stop is reached, the adjustment of the windowpane is ended if the door is pivoted. For example, in addition there is an activation of a so-called closing aid of the motorized door adjuster, in particular a closing aid mechanism, by means of which the door is moved against the end stop. In this case, additional power consumption occurs due to the closing aid. Because the adjustment of the windowpane ends, however, a total power consumption of the door module is reduced.

For example, the adjustment of the windowpane can be ended only when the second request corresponds to a closing movement. In this case, the door is moved in particular against a car body, a component of a car body, or a seal of the motor vehicle, which in each case act against the force required for the adjustment. Due to this counterforce an increased force and thus an increased electrical current is required for adjusting the door or activating the possible closing mechanism, which is why a power requirement for adjusting the door is increased. Because the adjustment of the windowpane ends, the total power consumption of the door module is limited.

Alternatively or particularly preferably in combination therewith, the adjustment of the windowpane can be ended only when the first request corresponds to a closing movement, therefore, when the windowpane is moved into a closed position or at least into a further closed position. In such a movement of the windowpane, pinching a possible person or an object by the windowpane is possible. Because the adjustment of the windowpane ends, such a risk is avoided, which is why it is not necessary to monitor the pinching by the windowpane during this time. As a result, complexity is reduced.

The adjustment of the windowpane can be resumed when the door adjustment has ended. Here, the adjustment takes place according to the first request, therefore, in the same direction and/or to the position predetermined by the first request. Thus, the temporary ending of the adjustment of the windowpane is an interruption, provided the windowpane is not yet in the position specified by the first request, therefore, in the desired position, when the adjustment ends. Thus, both the door and the windowpane are adjusted to the respective desired position, which increases convenience. Alternatively, after the adjustment of the windowpane has ended, no renewed adjustment movement of the windowpane takes place. This requires, for example, a third request. In other words, after the adjustment of the windowpane has ended, it will only be further adjusted if a third request is detected.

For example, pinch protection of the motorized window lift is adapted to the adjustment of the door. In other words, for example, a pinch protection parameter is changed when the second request is detected. Especially preferably, however, a setting of the pinch protection of the motorized window lift is not changed. Thus, the adjustment of the windowpane according to the first requirement with respect to the pinch protection occurs substantially independent of the second request and the adjustment of the door. In other words, the pinch protection setting is independent of the second request and the door adjustment. When the door is adjusted, it is possible that the windowpane is moved, independent of the motorized window lift. For example, the windowpane is shaken, in particular if the door is moved against an end stop. Due to such a shaking, it is possible that a case of pinching is identified incorrectly. Because the windowpane adjustment has ended, pinching by the windowpane is not possible. For example, the pinch protection is deactivated when the windowpane is not adjusted. Consequently, such shaking is not falsely identified as a case of pinching. Because of the temporary termination of the windowpane adjustment when the door is adjusted, in particular an adjustment of the windowpane is prevented when such shaking occurs. Therefore, it is possible to use relatively low thresholds for pinch protection, wherein, because of the windowpane adjustment ended in the case of the door adjustment, it is ensured that essentially every shaking of the windowpane corresponds to a case of pinching. Safety is increased due to the reduced thresholds.

For example, a specification of a control device is used as a first request or as a second request. For example, the first and/or second request is made when the motor vehicle is locked. Particularly preferably, however, a user input is used as the first request. The adjustment of the windowpane is requested by means of the user input. In this case, a switch, in particular a button, is suitably activated, which is integrated, for example, in a door of the motor vehicle. Alternatively, a switch of a radio remote control is operated, in particular in a specific pattern. Adjustment of the windowpane is requested in this way.

Alternatively or particularly preferably in combination therewith, a user input is used as a second request. The user input is requested, for example, by means of a switch, which is integrated in particular in a center console of the motor vehicle. Alternatively, the second request is made, for example, by means of a handle of the door module, in particular an external or internal handle. Thus, the method is consequently executed only if both the adjustment of the door and the adjustment of the windowpane are to occur due to a user input. Provided the adjustment is not to be made explicitly on the basis of a user input, but, for example, due to environmental parameters or other specifications, it is made possible to match the movement of the door and windowpane, so that an interruption or ending of the windowpane adjustment can be avoided before this has not reached the final position.

The door module can be part of a motor vehicle and has a door which is driven by means of a motorized door adjuster. The motorized door adjuster of the door module is connected, for example, to a carrier of the door module to which expediently the door as well is attached. Alternatively, the motorized door adjuster is provided and set up to be attached to a further component of the motor vehicle, for example, to an A- or B-pillar. The motorized door adjuster is operatively connected to the door, which expediently has a fitting or a receptacle for a fitting for connection to another component of the motor vehicle, such as an A- or B-pillar. By means of the motorized door adjuster, the door is moved during operation along an adjustment path predetermined by the fitting, for example, pivoted or moved, if the fitting is a hinge or a running rail or the like.

Furthermore, the door module can have a windowpane, which is driven by means of a motorized window lift. The motorized window lift is expediently connected, for example, fastened, to the possible carrier. The motorized window lift is operatively connected to the windowpane, so that when the motorized window lift is activated, the windowpane is adjusted, in particular moved, suitably along a straight line.

The motorized door adjuster and the motorized window lift each have an electric motor, which is expediently designed brushless. Preferably, the two electric motors are each DC motors and suitably brushless DC motors (BLDC). Expediently, in each case a gear, which is operatively connected to the door or windowpane, is driven by each electric motor. The gear is preferably a worm gear, so that self-locking or at least a tightness is realized, provided the electric motor is not operated. A variable-length control part, such as a cable pull or a spindle, is preferably driven by a gear.

The door module further has a control unit which is fastened, for example, to the carrier. The control unit comprises, for example, a programmable microprocessor or an application-specific circuit (ASIC). The control unit is operated according to a method in which a first request for adjusting the windowpane is detected and in which the windowpane is adjusted depending on the first request. Further, a second request for adjusting the door is detected and the door is adjusted depending on the second request. The adjustment of the windowpane is ended at least temporarily while the door is adjusted. For this purpose, the control unit is expediently coupled to the motorized door adjuster and/or the motorized window lift by signals and/or electrically. For example, the control unit is suitable, in particular provided and set up, for being operated according to the method. The control unit is, for example, connected by signals to a bus system of the motor vehicle, for example, a CAN bus or a LIN bus. In particular, the first and/or second request are transmitted to the control unit by the bus system. In other words, the first and/or second request are detected by means of receiving.

For example, both the motorized door adjuster and the motorized window lift each have a control device by means of which a current is provided, by means of which the respective electric motor is operated. Each control device has, for example, a current control or current regulator. The control devices are expediently contacted electrically with an electrical system of the motor vehicle, which provides, for example, an electrical (DC) voltage of 12 volts, 24 volts, or 42 volts. However, the control unit particularly preferably has a current setting unit, in particular a current regulator, such as a inverter. This is electrically contacted with the electrical system of the motor vehicle and energized by it in that it provides, for example, a DC electrical voltage of 12 volts, 24 volts, or 42 volts. An electric current is provided by the current setting unit, wherein in particular a regulation takes place, so that the current setting unit is a current regulator. A switch is connected downstream, in terms of regulation, of the current regulator, so that the switch is supplied with the regulated electric current or at least a phase thereof. Expediently, the current is a direct current.

The switch has two outputs, wherein the input is electrically contacted with the current regulator. One of the outputs is electrically contacted with the motorized door adjuster, in particular with the electric motor of the motorized door adjuster. The further output is electrically contacted with the motorized window lift, in particular its electric motor. It is thus possible to control by means of a single current regulator both the electric motor of the motorized door adjuster and the electric motor of the motorized window lift. The assignment takes place by actuation of the switch, which is, for example, a changeover switch. Thus, either the one or the other electric motor is operated by the current regulator. Preferably, the respective remaining pole of the electric motors is taken to ground, and a current regulation by the current regulator is to ground, which simplifies an interconnection. Manufacturing costs are reduced due to only the single current regulator.

In summary, the door module has the control unit, which comprises the current regulator, in particular an inverter, and the switch connected downstream, in terms of regulation, to it with two outputs whose one output is electrically contacted with the motorized door adjuster and the other output with the motorized window lift. For example, two other consumers are electrically contacted with the switch instead of the motorized door adjuster and the motorized window lift.

The refinements and advantages stated in connection with the method for operating a door module of a motor vehicle are analogously also to be applied to the door module and vice versa.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
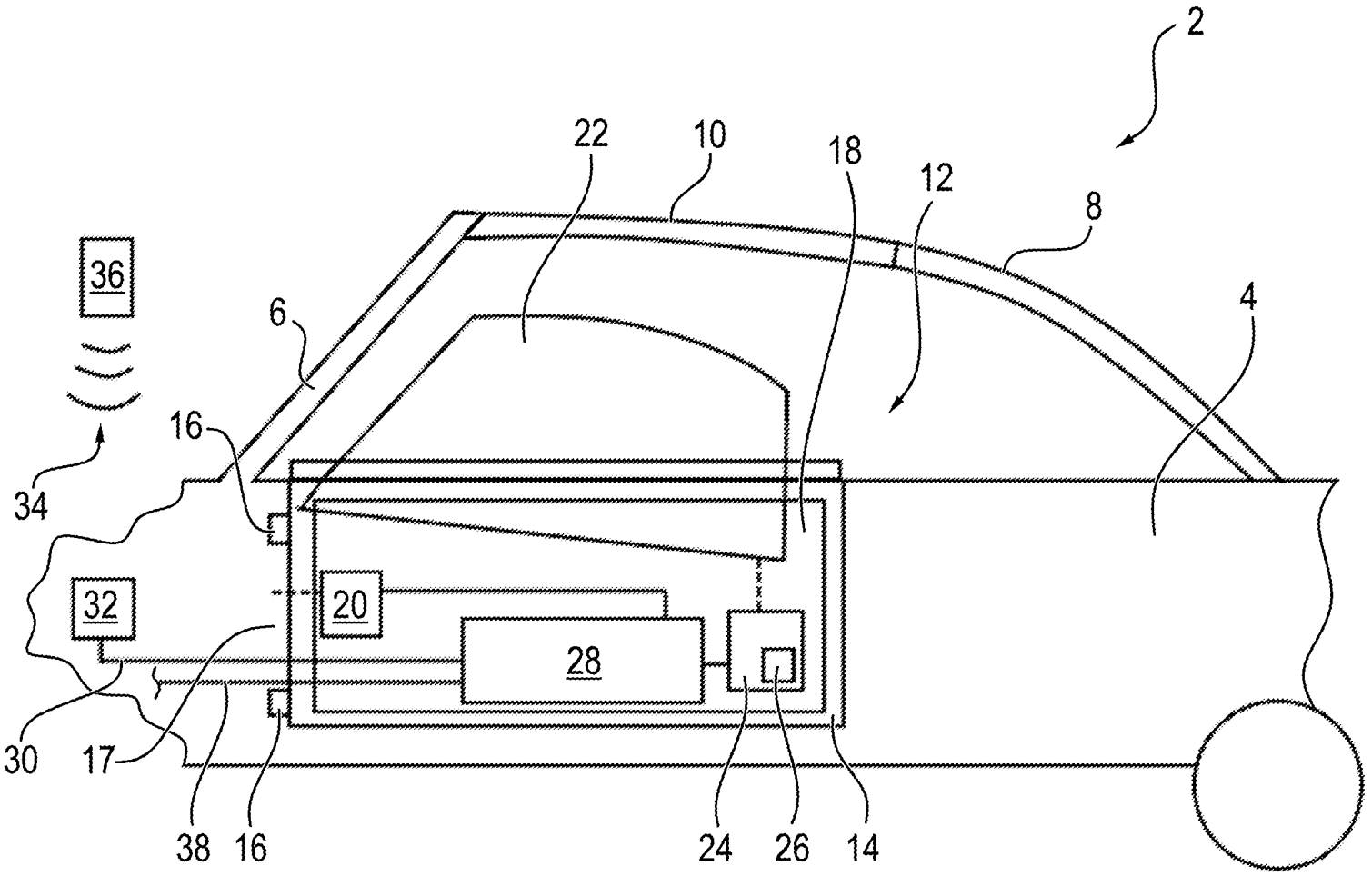
FIG. 1 shows schematically as a partial view a motor vehicle with a door module.

In FIG. 1, a motor vehicle 2 in the form of a cabriolet is shown schematically in a partial side view. Motor vehicle 2 has a body 4 with an A-pillar 6, which is made of a metal. In addition, motor vehicle 2 has a roof 8, which is designed as foldable and is made of a material. A seal 10 which is connected to roof 8 is located in an edge region of roof 8. Seal 10 is made of a plastic and is a flexibly designed molding. Motor vehicle 2 further has a door module 12 with a door 14, which is also made of sheet metal and is a part of body 4. Door 14 is fastened by means of two fittings 16 in the form of hinges to a further component of body 4, namely a door frame 17, so that door 14 can be pivoted with respect to the further parts of body 4, in particular with respect to door frame 17. Door frame 17 is stationary with respect to A-pillar 6.

Door module 12 further comprises a carrier 18, which is made of a plastic in a plastic injection molding process, and which is fastened to the inside of door 14. A motorized door adjuster 20 is attached to carrier 18. This has an electric motor, that can be designed as brushless, which drives a worm gear. The worm gear itself is operatively connected to other components of motorized door adjuster 20, which is supported against door frame 17. Thus, it is made possible, upon activation of motorized door adjuster 20, to pivot door 14 and therefore also carrier 18 with respect to door frame 17. In other words, the position of door 14 with respect to door frame 17 is adjusted by motorized door adjuster 20.

In addition, door module 12 comprises a windowpane 22, which is driven by a motorized window lift 24. Motorized window lift 24 is connected to carrier 18, which has guides for windowpane 22, so that upon activation of motorized window lift 24, windowpane 22 is moved along a linear adjustment path with respect to carrier 18. Motorized window lift 24 comprises an electric motor, which is designed as brushless and by means of which a worm gear is driven, which in turn is operatively connected to a carriage, which is connected to windowpane 22. The carriage and the worm gear are operatively connected to each other, for example, by means of a cable pulley or the like. When closed, windowpane 22 bears against seal 10. Door module 12 thus has no frame for window pane 22, which is why it can be moved substantially freely.

Motorized window lift 24 further includes pinch protection 26, which is used to monitor whether an object, such as an article or a user's hand, is pinched by windowpane 22 during its movement, in particular between windowpane 22 and roof 8 or seal 10. In a refinement, it is also monitored whether during a movement of windowpane 22 into the open position, pinching of a possible object takes place between the windowpane and door 14.

Door module 12 further comprises a control unit 28, which is connected by signals to a bus system 30 of motor vehicle 2. Bus system 30 transmits information and commands to control unit 28, which are evaluated and processed there. A radio receiver 32 is coupled by signals to bus system 30 and signals can be supplied by it to the bus system and consequently can be transmitted to control unit 28. In this case, radio signals 34, which are created by a radio transmitter 36, are received by radio receiver 32. Radio transmitter 36 is a key of motor vehicle 2, and radio signals 34 are encrypted and encoded so that only radio signals 34 are further processed by radio receiver 32 and supplied to bus system 30 when radio transmitter 36 is registered and has, for example, a specific serial number or a specific key.

In addition, control unit 28 is electrically connected to an electrical system 38 of the motor vehicle, by means of which a DC electrical voltage of 12 volts or 42 volts is provided. Control unit 28, by means of which motorized window lift 24 and motorized door adjuster 20 are energized, is energized by means of electrical system 38. Thus, the electric motor of motorized door adjuster 20 or the electric motor of motorized window lift 24 is regulated by means of control unit 28.

Figure 2:
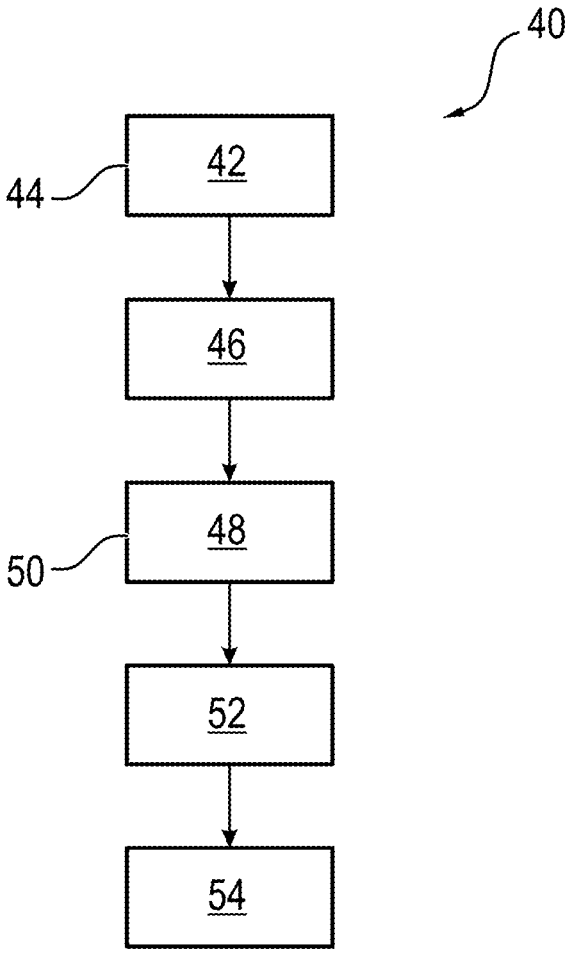
FIG. 2 shows a method for operating the door module.

FIG. 2 shows a method 40 for operating door module 12 of motor vehicle 2, which is carried out by means of control unit 22. In a first step 42, a first request 44 for adjusting windowpane 22 is detected. First request 44 is made by radio transmitter 36 and transmitted by radio signals 34 to radio receiver 32. By means of radio receiver 32, first request 44 was supplied to bus system 30 and received by control unit 28 and thus detected. First request 44 corresponds to a request to adjust windowpane 22. Here, windowpane 22 is to be moved from a partially open position to the completely closed position. Thus, first request 44 corresponds to a closing movement.

In a subsequent second step 46, windowpane 22 is adjusted. For this purpose, motorized window lift 24 is energized by control unit 28 and windowpane 22 is moved upward in the vertical direction. Further, pinch protection 26 is activated due to the closing movement of windowpane 22. In a subsequent third step 48, a second request 50 is detected by control unit 28. Second request 50 corresponds to a closing movement, so that door 14 is to be moved such that it is flush with other components of body 4 and thus should be moved from an open or partially open position to the completely closed position. Second request 50 is made by means of a handle of door module 12, which handle is attached to door 14 and which has been manually activated by a user. Thus, a user input is used in each case as first request 44 and as second request 50.

In a subsequent fourth step 52, the adjustment of windowpane 22 is ended and thus the energization of motorized window lift 24 by control unit 28 is ended. Following this, the energization of motorized door adjuster 20 is started and door 14 and consequently also door module 12 are pivoted with respect to door frame 17 until door 14 is in the closed position. For this purpose, a closing mechanism of motorized door adjuster 20 is called upon and used. As a result, door 14 is engaged with other components of body 4, such as door frame 17, in particular by means of a lock. Subsequently, door 14 is in the position desired by second request 50, and the energization of motorized door adjuster 20 by control unit 28 is ended. In other words, the adjustment of windowpane 22 is ended as long as door 14 is being adjusted.

In a further alternative, the energization of motorized door adjuster 20 is started in the fourth step 52, while motorized window lift 24 is operated. In other words, both motorized door adjuster 20 and motorized window lift 24 are operated simultaneously. When door 14 approaches the end stop formed by door frame 17, the energization of motorized window lift 24 is ended. In particular, the energization is ended when door 14 is less than 5 cm, 4 cm, or 1 cm away from the closed position. Alternatively, the energization of motorized window lift 24 is ended, and thus the adjustment of windowpane 22 is ended when the closing mechanism of motorized door adjuster 20 is activated and door 14 is consequently moved into the completely closed position. In this case, in addition, a lock of door module 12 is engaged with a counterpart, which is fastened to door frame 17. In other words, the adjustment of windowpane 22 is ended when door 14 is moved against the end stop provided by means of door frame 17.

In a subsequent fifth step 54, which is carried out when fourth step 52 and thus the adjustment of door 14 are ended, the adjustment of windowpane 22 is resumed and thus windowpane 22 is moved into the position specified/desired by first request 44, in particular the completely closed position, so that it bears against seal 10 after completion of fifth step 54.

During the implementation of method 40, a setting of pinch protection 26 is not changed. The setting of pinch protection 26, like its parameters, is independent of first request 44 and second request 50, so that in each case the same occurring measured variables, such as electrical currents, lead to a triggering of pinch protection 26, regardless of whether door 14 is adjusted at the same time and/or regardless of the direction in which door 14 and/or windowpane 22 are adjusted.

In summary, the movement of windowpane 22 is adapted to the movement of door 14. In this case, information about the movement of door 14 is present due to motorized door adjuster 20 and is used, for example, as the input signal for the adjustment of windowpane 22 and thus motorized window lift 24. Consequently, it is possible to stop the movement of windowpane 22 when door 14 is just before the completely closed position. Due to the stopping of windowpane 22, pinch protection 26 is not erroneously triggered when a jolt passes through door 14 and side window 22 when this comes into the completely closed position, for example, into the lock. Thus, it is not necessary to design pinch protection 26 more robustly. In other words, it is not necessary to design pinch protection 26 more robustly when door 14 is slammed shut. As soon as door 14 is completely closed, the movement of windowpane 22 is resumed.

Thus, the movement of windowpane 22 is stopped, if an adjustment of door 14 takes place by means of motorized door adjuster 20, so that electrical system 38 and/or any lines to control unit 28 are not loaded simultaneously with two consumers, which have a relatively high energy consumption. Therefore, an electrical voltage drop is avoided. For example, the drives of motorized door adjuster 20 and motorized window lift 24 are driven by means of only the single control unit 28, which is a so-called "Door Control Unit" (DCU). Thus, control unit 28 is supplied only via a single line. Consequently, the load on other components and the electronics is reduced, wherein, in addition, a reverse polarity protection is realized in the production. As a result, an electrical current occurring during operation is comparatively low, and a thermal load is thus reduced. For this reason, relatively inexpensive components can be used for door module 12. Thus, the load on lines to control unit 28 is reduced, which is why a higher supply voltage/power is available. In addition, manufacturing costs for the electronics are reduced due to elimination of a reverse polarity protection for connection of motorized window lift 24 and motorized door adjuster 20.

For example, windowpane 22 is lowered, if it is in the completely closed position, therefore, completely closed, when door 14 is closed. Thus, an increase of an internal pressure in motor vehicle 2 is prevented and closing of door 14 is facilitated. As a result, it is possible to use an electric motor with lower power for motorized door adjuster 20.

For example, side window 22 is closed only when door 14 is in the completely closed position. In this way, it is ensured that the closing of windowpane 22 functions without any problems, whereby catching or the like on seal 10 is prevented. In particular, if motor vehicle 2 has a plurality of door modules 12 and the closing of all components, therefore, all doors 14 and all windows 22, is requested, all doors 14 are first pivoted into the closed position and the respective locks activated, and thus door 14 is closed. For example, in each case the respective door closing aid (closing mechanism) for realizing this position is at least temporarily activated. Only after this are side windows 22 moved into the completely closed position. Thus, catching or snagging of windowpane 22 during the closing movement of door 14 on seal 10 or the like is prevented.

For example, a speed at which windowpane 22 is moved is adjusted when door 14 is adjusted. In this case, for example, the speed at which windowpane 22 is moved is slowed down, accelerated, or completely paused. Alternatively, the movement of door 14 is adjusted when windowpane 22 is moved, in particular is adjusted. In this case, the adjustment of door 14 is accelerated, slowed, or paused, for example. In summary, there is a prioritization of the movements, therefore the movement of windowpane 22 or door 14. In this case, the load on electrical system 38 and in particular on the lines and control unit 28 is reduced, wherein in addition a reverse polarity protection is available.

The invention is not limited to the exemplary embodiment described above. Rather, other variants of the invention can also be derived herefrom by the skilled artisan, without going beyond the subject of the invention. Particularly, further all individual features described in relation to the exemplary embodiment can also be combined with one another in a different manner, without going beyond the subject matter of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claim.

What is claimed is:

1. A method for operating a door module of a motor vehicle having a door that is driven via a motorized door adjuster and having a windowpane that is driven via a motorized window lift, the method comprising:

detecting a first request for adjusting the windowpane;

adjusting the windowpane based on the first request, at least when the door is open and when the door is closed;

detecting a second request for adjusting the door;

adjusting the door based on the second request; and ending the adjustment of the windowpane based on the detecting of the second request, at least temporarily, while the door is adjusted by the motorized door adjuster, wherein the door is connected to the motor vehicle via a hinge, an opening movement pivoting the door about the hinge.

2. The method according to claim 1, wherein the adjustment of the windowpane is ended as long as the door is adjusted.

3. The method according to claim 1, wherein the adjustment of the windowpane is ended only when the door is moved against an end stop.

4. The method according to claim 3, wherein the adjustment of the windowpane is ended only when the second request corresponds to a closing movement.

5. The method according to claim 4, wherein the adjustment of the windowpane continues after the second request, if the second request corresponds to an opening movement.

6. The method according to claim 3, wherein the adjustment of the windowpane is ended only when the first request corresponds to a closing movement.

7. The method according to claim 3, wherein the adjustment of the windowpane is ended only when the first request and the second request corresponds to a closing movement.

8. The method according to claim 1, wherein the adjustment of the windowpane is resumed when the adjustment of the door has ended.

9. A door module of a motor vehicle comprising:

a door that is adapted to be driven via a motorized door adjuster;

a windowpane that is adapted to be driven via a motorized window lift; and a control unit that is operated in accordance with the method according to claim 1.

10. A method for operating a door module of a motor vehicle having a door that is driven via a motorized door adjuster and having a windowpane that is driven via a motorized window lift, the method comprising:

detecting a first request for adjusting the windowpane;

adjusting the windowpane based on the first request;

detecting a second request for adjusting the door;

adjusting the door based on the second request; and ending the adjustment of the windowpane based on the detecting of the second request, at least temporarily, while the door is adjusted, wherein a setting of a pinch protection of the motorized window lift is not changed, wherein the door is connected to the motor vehicle via a hinge, an opening movement pivoting the door about the hinge.

11. The method according to claim 1, wherein a user input is used as the first request or the second request.

* * * * *